US010066171B2

(12) United States Patent
Lobue et al.

(10) Patent No.: US 10,066,171 B2
(45) Date of Patent: Sep. 4, 2018

(54) METHOD FOR STRIPPING AND EXTRACTION OF USED LUBRICATING OIL

(71) Applicant: Solvex Process Technologies LLC, Kingwood, TX (US)

(72) Inventors: Christopher Joseph Lobue, Montgomery, TX (US); Gary Lynn Hensley, Kingwood, TX (US)

(73) Assignee: Solvex Process Technologies LLC, Kingwood, TX (US)

( * ) Notice: Subject to any disclaimer, the term of this patent is extended or adjusted under 35 U.S.C. 154(b) by 1058 days.

(21) Appl. No.: 14/458,487

(22) Filed: Aug. 13, 2014

(65) Prior Publication Data

US 2015/0048005 A1 Feb. 19, 2015

Related U.S. Application Data

(60) Provisional application No. 61/865,398, filed on Aug. 13, 2013.

(51) Int. Cl.
*C10G 31/06* (2006.01)
*C10G 7/00* (2006.01)

(52) U.S. Cl.
CPC ..... *C10G 31/06* (2013.01); *C10G 7/003* (2013.01); *C10G 2400/04* (2013.01)

(58) Field of Classification Search
CPC ..... C10G 2400/04; C10G 31/06; C10G 7/003
See application file for complete search history.

(56) References Cited

U.S. PATENT DOCUMENTS

| | | | |
|---|---|---|---|
| 4,021,333 | A | 5/1977 | Habiby et al. |
| 4,071,438 | A | 1/1978 | O'Blasny |
| 4,101,414 | A | 7/1978 | Kim et al. |
| 4,302,325 | A | 11/1981 | Fletcher et al. |
| 4,840,721 | A | 6/1989 | Kalnes et al. |
| 5,244,565 | A | 9/1993 | Lankton et al. |
| 5,302,282 | A | 4/1994 | Kalnes et al. |
| 5,384,037 | A | 1/1995 | Kalnes |
| 5,447,628 | A | 9/1995 | Harrison et al. |
| 6,068,759 | A | 5/2000 | Moore et al. |
| 6,117,309 | A | 9/2000 | Daspit et al. |
| 6,402,937 | B1 | 6/2002 | Shaffer, Jr. et al. |
| 6,402,938 | B1 | 6/2002 | Moore et al. |
| 6,447,672 | B1 | 9/2002 | Moore et al. |

(Continued)

*Primary Examiner* — Renee Robinson
*Assistant Examiner* — Derek N Mueller
(74) *Attorney, Agent, or Firm* — Stephen S. Hodgson

(57) ABSTRACT

A continuous, hot vapor stripping process recovers base oil from used lubricating oils (ULO) containing lubricating oil boiling range material, with further refining using solvent extraction to produce a high quality base oil. The ULO is charged to a first stripping column along with a stripping vapor to vaporize lubricating oil boiling range components, which are fed to a second stripping column to separate diesel boiling range material from the lubricating oil boiling range components. A lubricating boiling range material is removed as a bottoms product and fed to a liquid-liquid extractor to produce a raffinate stream and an extract stream. The raffinate stream is fed to a raffinate distillation column, where a base oil product is recovered as a bottoms stream. The extract stream is fed to an extract distillation column, where an aromatic oil product is recovered as a bottoms stream.

24 Claims, 1 Drawing Sheet

(56) References Cited

U.S. PATENT DOCUMENTS

| | | | | |
|---|---|---|---|---|
| 7,150,822 | B1 | 12/2006 | Malone | |
| 7,241,377 | B2 | 7/2007 | Malone | |
| 7,341,656 | B1 | 3/2008 | Malone et al. | |
| 8,366,912 | B1 * | 2/2013 | MacDonald ..... | C10G 71/00<br>208/144 |

* cited by examiner

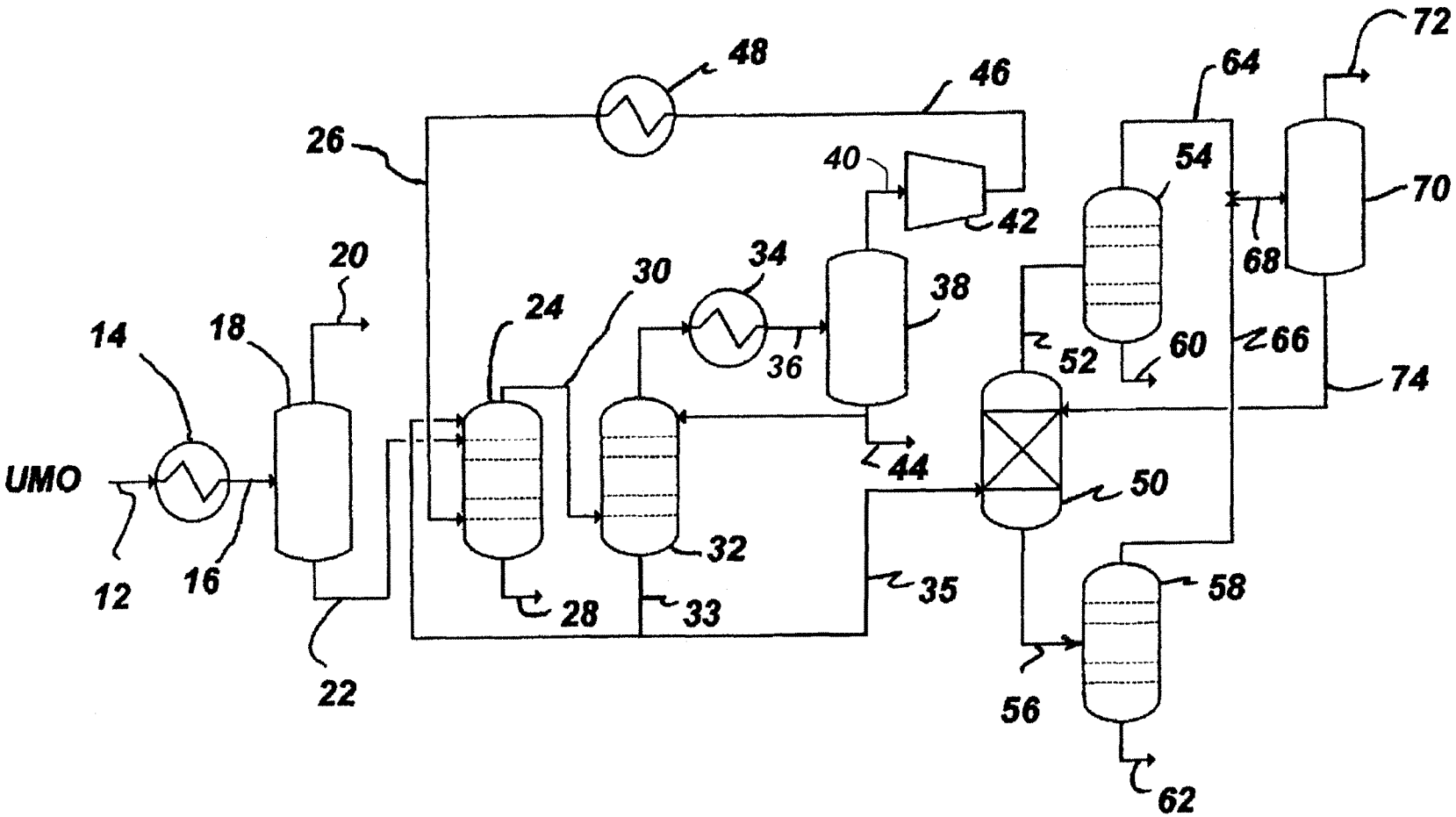
UMO
12
14
16
18
20
22
24
26
28
30
32
33
34
35
36
38
40
42
44
46
48
50
52
54
56
58
60
62
64
66
68
70
72
74

METHOD FOR STRIPPING AND EXTRACTION OF USED LUBRICATING OIL

This application claims the benefit of U.S. Provisional Patent Application No. 61/865,398 filed Aug. 13, 2013.

FIELD OF THE INVENTION

This invention relates to the field of re-refining waste oils for use in lubricants. In particular this invention relates to methods of re-refining used lubricating oils to produce re-refined base oils. The methods of the invention incorporate the steps of stripping followed by extraction of undesirable contaminants with a liquid extractant.

DESCRIPTION OF THE PRIOR ART

The prior art in this area is exemplified by U.S. Pat. Nos. 4,021,333; 4,071,438; and 4,302,325. Other patents which may relate to this invention include U.S. Pat. Nos. 6,068,759; 6,447,672; 6,402,937; 6,402,938; 7,341,656; 4,840,721; 5,384,037; and 6,117,309.

Liquid-liquid extraction finishing re-refining processes have the inherent advantage relative to alternative base oil re-refining processes of not requiring the consumption of hydrogen or clay and of not generating any voluminous or hazardous waste byproduct streams. However, such processes have heretofore had significant economic shortcomings. Because of these shortcomings, all of the prior art patents in this area have expired, are nearing expiration, or have been allowed to expire without having been commercialized.

Relative to hydro-finishing, which is the predominant re-refined base oil finishing process employed in the United States, such liquid-liquid extraction processes eliminate the requirement for hydrogen, reduce the production of environmentally problematic byproducts, and thus are inherently safer (presuming a relatively non-toxic extractant is used), and eliminate the need for periodic catalyst replacement and handling.

However, unless practiced according to the methods of this invention, such processes either require a large and uneconomic volume of solvent, which contributes to a low yield of re-refined base oil, or produce a re-refined base oil of relatively low quality, which could be more simply produced via clay finishing. Where high quality base oil is required, these shortcomings have heretofore caused these processes to be significantly less cost effective than hydro-finishing and accordingly have precluded their commercial implementation, notwithstanding their inherent advantages. Moreover, unless practiced according to the methods of this invention, such prior art processes may result in unacceptable fouling of process equipment.

OBJECTS OF THE INVENTION

An object and advantage of the present invention is to safely achieve a relatively high yield of high quality re-refined base oil using nitrogen stripping and extraction. Further objects and advantages of the invention include reducing the volume of re-circulating extractant required to produce a re-refined oil of a given quality. Therefore reduces the size and cost of the recovery system, as well as lowers the energy cost of operation. A still further object of the invention is to permit such efficient stripping of the base oil without unacceptable fouling of process equipment.

Most broadly, the object of the invention is to provide an economically attractive, safe alternative to hydro-finishing of re-refined oils which produces a base oil of comparable quality with few of hydrofinishing's operational and environmental liabilities.

SUMMARY OF THE INVENTION

These and other objects of the invention are attained by continuously charging a used lubricating oil fraction to a stripping column; continuously injecting into the used lubricating oil fraction a non-hydrogenating heating vapor, and wherein the amount and temperature of the injected heating vapor is sufficient to vaporize at least a portion of the lubricating oil boiling range components, which are continuously removed as an overhead vapor fraction; and continuously removing from a bottom portion of the thermal treatment means a bottoms fraction. The overhead vapor fraction is then fed to a second stripping column where the overhead condenser is operated to condense diesel boiling range components and any water provided water is present in an amount to be condensed with typical cooling tower water temperature and where lubricating boiling range components are removed as a product from the bottoms. We have discovered that liquid-liquid extraction finishing processes for used oil are surprisingly sensitive to the configuration of the stripping apparatus used prior to finishing. Use of a stripping column with effective trays and multiple theoretical plates to strip the used lubricating oil prior to finishing, permits a high quality re-refined oil to be finished through liquid-liquid extraction on a more cost effective basis than is possible through hydro-treating or any other known finishing process. However, if in accordance with typical re-refining practice, loose grid packing or a wiped film evaporator is employed for distillation prior to finishing, liquid-liquid extraction finishing is less economically attractive than hydro-finishing. The failure to recognize the importance of this issue has precluded successful commercialization of the prior art processes in this area notwithstanding the well developed body of knowledge on the design and construction of liquid-liquid extraction units themselves, which have been perfected in the course of their application to virgin lubricant processing in solvent refining units.

To summarize a preferred embodiment of the process, the oil is first pretreated, employing means well known to those schooled in the art, to remove a portion of the water and a portion of the volatile low boiling components unsuitable for incorporation in lubricants.

The pretreated oil is then stripped in a trayed column having multiple theoretical plates, equilibrium stages, or steps. The apparatus employed must have more than one theoretical plate, and will preferably have more than two theoretical plates.

Stripping in the aforesaid trayed column separates the diesel and lubricating oil boiling range material with an equivalent boiling range of approximately 350° F. (176.7° C.) to 1000° F. (537.8° C.) from the heavy asphaltic components and metals which are unsuitable for incorporation in lubricants and which also tend to frustrate solvent extraction finishing.

Following the initial stripping column, the overhead fraction is routed to a second stripping column containing enough theoretical stages to separate the diesel boiling range material from the lubricant boiling range material. The overhead condenser is operated to condense the diesel boiling range material and any water that may condense under the conditions of the stripping column with cooling tower water temperatures. Following the second stripping column the vapor fraction produced consisting of the injected stripping vapor and any non condensables are preferably recycled back to a heater for re-use in the first stripping column. Also it is preferred when recycling the stripping vapor to purge a small amount of stripping vapor from the loop to prevent the build up of non-condensables. Following the second stripping column to remove the diesel boiling range material the bottom product is fed to a countercurrent liquid-liquid extractor such as a mixer settler or a rotating disk contactor where they are contacted with an extractant such as N-Methyl-2-Pyrrolidone (NMP) at a temperature below the temperature of complete miscibility of the solvent and the oil. The extractant will ordinarily be a polar organic solvent or a mixture thereof. It should be preferentially miscible with and thereby preferentially extract undesirable impurities, such as aromatics, unsaturated hydrocarbons, sulfur, nitrogen, and oxygen containing compounds, from the oil over some range of temperatures and pressures. It should be, at the operating temperatures and pressures, relatively immiscible with the primary product material base oil which is being purified.

Raffinate and extract phases are formed in the liquid-liquid extractor in a manner well known to those schooled in the art, and the polar and aromatic components of the lubricating oil boiling range material which are undesirable in a finished base oil (including the polar and aromatic compounds), are concentrated in the extract phase, leaving a relatively purified oil in the raffinate phase. Following stripping, pursuant to the methods of this invention, relatively low solvent dosages in the area of 50% solvent to oil generally give satisfactory results, with the precise level dependent on the character of the oil, and the finished base oil quality and yield desired.

Following extraction, the extraction solvent is separately distilled from the raffinate and extract phases and recovered for re-use. The distilled raffinate, typically 90% of the original lubricating oil boiling fraction, is a finished base oil of high quality. The distilled extract, typically 10% of the original lubricating oil boiling fraction, is suitable as a fuel or for fuel blending, and may optionally be blended with the lighter boiling components of the oil, which have similar utility.

The invention can be more completely understood with reference to the accompanying drawing FIG. 1, which provides a schematic flow sheet of a preferred embodiment of the invention. In that the individual underlying process units in FIG. 1 are well known to those schooled in the art, they are presented in block schematic form, without enumeration of the pumps, valves, and other equipment which one of ordinary skill in the art will recognize are necessary for each process unit to function.

BRIEF DESCRIPTION OF THE DRAWING

FIG. 1 is a schematic diagram of a preferred embodiment of a system arranged in accordance with the teachings of the present invention.

DETAILED DESCRIPTION OF A PREFERRED EMBODIMENT

FIG. 1 depicts a presently preferred system 10 for the nitrogen stripping of used lubricating oil in accordance with this invention. In the system 10, used lubricating oil (ULO) is continuously introduced through an inlet line 12 into a pre-heat exchanger 14 where the ULO is pre-heated to a desired temperature, preferably about 300° F. The pre-heated ULO is directed from the pre-heat exchanger 14 through an effluent line 16 into a pre-heat flasher 18 wherein the more volatile components of the ULO are flashed and withdrawn through an overhead line 20. These components comprise primarily water and a gasoline boiling range overhead product. The gasoline boiling range product is sold into fuels markets as it is unsuitable for lubricating oil.

With the overhead product removed, the ULO passes through a flasher drain line 22 at desired temperature, preferably about 300° F., and is continuously charged into a first ULO nitrogen stripping trayed column 24, which is referred to as a first stripping column. In the column 24, the system continuously injects a non-hydrogenating stripping vapor, preferably at 500° F. to 1000° F. through an injection line 26 sufficient to vaporize the lubricating oil boiling range components. Stripping vapors to consider include nitrogen, hydrogen, methane, ethane, propane, steam and an inert gas. The first ULO nitrogen stripper column 24 bottoms product is continuously removed from the first column 24 by way of a drain line 28. The diesel and lube oil boiling range overhead material is withdrawn from the column 24 by way of overhead line 30.

The diesel and lube oil boiling range material of the ULO then flows from the first stripper column 24 into a second stripper column 32. Overhead diesel boiling range material from the second stripper column 32 flows into a condenser 34 to condense this product for further processing, exiting the condenser 34 at about 120° F. through a line 36. Preferably, a portion of the bottom product from the second stripper column 32 flows through a drain line 33 back to the first stripper column 24 for further processing. The remainder of the bottom product flows through a line 35 to a solvent extractor as described below.

The line 36 feeds into accumulator vessel 38. In the accumulator 38, the stripping gas and any non condensables are separated from the diesel boiling range components and exit 38 through an overhead line 40 at about 120° F. into a compressor 42. Also from accumulator 38, a portion of the diesel boiling range material is refluxed back to 32 and the balance flows through a drain line 44.

The stripping vapor is compressed in compressor 42 and flows through line 46 to a heater 48 where it is recycled to the first stripper column 24.

Solvent from line 74 is fed to the solvent extractor 50. Solvents to consider using in solvent extractor 50 include NMP, phenol and dimethylformamide. Preferably the solvent used in extraction is NMP. A multistage liquid-liquid extractor can be used as the solvent extractor 50 such as a multi-stage countercurrent mixer settler, a multistage rotating disk contactor, a york-scheibel column or a fixed bed extraction column. The solvent extractor 50 discharges raffinate through a line 52 into distillation column 54. The solvent extractor 50 also discharges extract through a line 56 into distillation column 58.

Raffinate distillation column 54 is operated at a temperature and pressure suitable to remove remaining solvent from raffinate stream and produce a base oil product. Raffinate column 54 is preferably operated under vacuum and preferably has low pressure drop packing.

The recovered solvent from 54 leaves as overhead stream 64. The base oil product from 54 leaves as bottom stream 60.

Extract distillation column 58 is operated at a temperature and pressure suitable to remove remaining solvent from extract stream and produce a aromatic oil product. Extract column 58 is preferably operated under vacuum and preferably has low pressure drop packing.

The recovered solvent from 58 leaves as overhead stream 66. The aromatic oil product leaves 58 as bottom stream 62.

The recovered solvent from streams 66 and 64 are fed to solvent recycle tank 70, via stream 68.

The principles, preferred embodiment, and mode of operation of the present invention have been described in the foregoing specification. This invention is not to be construed as limited to the particular forms disclosed, since these are regarded as illustrative rather than restrictive. Moreover, variations and changes may be made by those skilled in the art without departing from the spirit of the present invention.

We claim:

1. A continuous process for recovering lubricating oil boiling range hydrocarbons from used lubricating oil, comprising the steps of:

i) continuously charging a used lubricating oil fraction (ULO) to a first stripping column;

ii) continuously injecting into said used lubricating oil fraction a non-hydrogenating stripping vapor in an amount and at a temperature sufficient to vaporize at least a portion of lubricating oil boiling range components in said used lubricating oil fraction, wherein said lubricating oil boiling range components are continuously removed as a first overhead vapor fraction;

iii) removing from a bottom portion of said first stripping column a bottoms fraction;

iv) continuously feeding said first overhead vapor fraction to a second stripping column to separate diesel boiling range material from lubricating oil boiling range material, wherein said diesel boiling range material is removed as a second overhead vapor fraction;

v) cooling said second overhead vapor fraction with a temperature sufficiently low enough to condense the diesel boiling range material and any water that may condense along with the diesel boiling range material, and removing a portion of the diesel boiling range material while refluxing the balance of the diesel boiling range material back to said second stripping column and producing a stripping vapor fraction comprising the injected stripping vapor and any non-condensables; and vi) removing from the second stripping column a lubricating oil boiling range material as a bottoms product.

2. The process of claim 1, wherein the ULO is first subjected to heating and flashing to remove at least a portion of gasoline boiling range components and a portion of the water as an overhead product and wherein bottoms product from flashing is fed to the first stripping column.

3. The process of claim 1, wherein the stripping vapor is nitrogen.

4. The process of claim 1, wherein the stripping vapor is methane.

5. The process of claim 1, wherein the stripping vapor is ethane.

6. The process of claim 1, wherein the stripping vapor is propane.

7. The process of claim 1, wherein the stripping vapor is steam.

8. The process of claim 1, wherein the stripping vapor is an inert gas.

9. The process of claim 1, wherein the stripping vapor is an inert non-flammable gas.

10. The process of claim 1, wherein the stripping vapor fraction is compressed, reheated and recycled back to the first stripping column.

11. The process of claim 1, wherein the first and second stripping columns operate at a pressure of 0.1-10 atmospheres absolute.

12. The process of claim 1, wherein the first and second stripping columns have multiple stages.

13. The process of claim 1, wherein the first stripping column is a tray column.

14. The process of claim 1, wherein the first stripping column is a tray column that has more than two distillation trays, wherein a tray one is an uppermost tray and a tray two is immediately below tray one, and wherein the first stripping column is fed on tray two.

15. The process of claim 14, wherein a portion of the lubricating oil boiling range material from the bottom of the second stripping column is fed on tray one of the first stripping column.

16. A continuous process for producing base oil from used lubricating oil, comprising the steps of:

i) continuously charging a used lubricating oil fraction (ULO) to a first stripping column;

ii) continuously injecting into said used lubricating oil fraction a non-hydrogenating stripping vapor in an amount and at a temperature sufficient to vaporize at least a portion of lubricating oil boiling range components in said used lubricating oil fraction, wherein said lubricating oil boiling range components are continuously removed as a first overhead vapor fraction;

iii) removing from a bottom portion of said first stripping column a bottoms fraction;

iv) continuously feeding said first overhead vapor fraction to a second stripping column to separate diesel boiling range material from lubricating oil boiling range material, wherein said diesel boiling range material is removed as a second overhead vapor fraction;

v) cooling said second overhead vapor fraction with a temperature sufficiently low enough to condense the diesel boiling range material and any water that may condense along with the diesel boiling range material, and removing a portion of the diesel boiling range material while refluxing the balance of the diesel boiling range material back to said second stripping column and producing a stripping vapor fraction comprising the injected stripping vapor and any non condensables;

vi) removing from the second stripping column a lubricating oil boiling range material as a bottoms product;

vii) continuously feeding the lubricating oil boiling range material to a multistage liquid-liquid extractor along with an extractant to produce a raffinate stream and an extract stream;

viii) continuously feeding the raffinate stream to a raffinate distillation column to remove residual extractant as a raffinate column overhead stream and recycling to the liquid-liquid extractor and removing from a bottom portion of the raffinate distillation column a bottoms stream as a base oil product; and ix) continuously feeding the extract stream to an extract distillation column to remove residual extractant as an extract column overhead stream and recycling to the liquid-liquid extractor and removing from a bottom portion of the extract distillation column a bottoms fraction as an aromatic oil product.

17. The process of claim 16, wherein the extractant is NMP.

18. The process of claim 16, wherein the extractant is phenol.

19. The process of claim 16, wherein the extractant is dimethylformamide.

20. The process of claim 16, wherein the second stripping column is operated at conditions such that the bottoms product removed from second stripping column does not contain a hydrocarbon boiling range material that is equal to and less than the boiling point of the extractant.

21. The process of claim 16, wherein the liquid-liquid extractor is a multi-stage countercurrent mixer settler.

22. The process of claim 16, wherein the liquid-liquid extractor is a multistage rotating disk contactor.

23. The process of claim 16, wherein the liquid-liquid extractor is a york-scheibel column.

24. The process of claim 16, wherein the liquid-liquid extractor is a fixed bed extraction column.

* * * * *